United States Patent [19]

Miller

[11] 4,138,919

[45] Feb. 13, 1979

[54] STRING SET AND STRING SECURING APPARATUS FOR MUSICAL INSTRUMENTS

[76] Inventor: Roger D. Miller, 9670 Fawnridge Dr., Beverly Hills, Calif. 90210

[21] Appl. No.: 765,263

[22] Filed: Feb. 3, 1977

[51] Int. Cl.[2] ..... G10D 3/12; G10D 3/14

[52] U.S. Cl. ..... 84/297 R; 84/299; 84/304

[58] Field of Search ..... 84/267, 297–307

[56] References Cited

U.S. PATENT DOCUMENTS

| | | | |
|---|---|---|---|
| 448,229 | 3/1891 | Grill | 84/297 R |
| 455,221 | 6/1891 | Lorang | 84/298 |
| 554,254 | 2/1896 | Fitler | 84/304 |
| 1,363,902 | 12/1920 | Muller | 84/297 R |
| 2,029,135 | 1/1936 | Stanley et al. | 84/298 |
| 2,265,885 | 12/1941 | Armstrong | 84/299 |

FOREIGN PATENT DOCUMENTS

| | | | |
|---|---|---|---|
| 590886 | 6/1925 | France | 84/304 |

*Primary Examiner*—Lawrence R. Franklin
*Attorney, Agent, or Firm*—Thomas A. Fournie

[57] ABSTRACT

Disclosed are guitars having quick attach, quick release string securing mechanisms for use with string sets of measured lengths. A first embodiment of strings has loops formed on both ends, while a second embodiment of strings has a loop formed on one end and an anchor ball secured on the other. Each guitar disclosed has tuning mechanism including transversely extending string holding posts over which the string loops may be hooked. Guitars utilizing the first string embodiment have crosspiece structure carrying upwardly projecting posts around which the loops of the other strings ends can be hooked. The guitar utilizing the second string embodiment has crosspiece structure defining slotted rearwardly opening sockets for receiving the anchor balls secured on the other string ends. The string holding ends of each of the string holding posts are preferably formed as ball-shaped members and may be formed by screwing a ball on a treaded shaft.

12 Claims, 14 Drawing Figures

STRING SET AND STRING SECURING APPARATUS FOR MUSICAL INSTRUMENTS

BACKGROUND OF THE INVENTION

The present invention relates to musical instruments and particularly to musical stringed instruments, such as guitars.

Heretofore, various string and string securing arrangements have been devised for such musical instruments. Examples of the prior arrangements are illustrated in the following U.S. Pat. No.: Fitler-534,502; Fitler-554,254; Mueller-1,363,902; Martin-3,130,626; and Mari-3,313,196.

The prior art arrangements, however, have the disadvantage of being cumbersome. This is a serious disadvantage, for example to entertainers, since if a guitar string breaks during an onstage performance, the entertainer either has to have another tune guitar ready at his side or has to interrupt his performance for a substantial time period while he effects the change of the broken string.

Further, since the prior art arrangements are cumbersome and make the changing of guitar strings tedious and time consuming, guitar players and owners have tended to avoid string and string set replacement, only replacing a string when same is absolutely necessary, such as when a string breaks.

SUMMARY OF THE INVENTION

It is an object of the invention to provide an improved string set and cooperating string securing apparatus for stringed musical instruments, such as guitars, which enables an entertainer or other guitar player or owner to rapidly and simply effect the change of an individual broken string or the whole string set of the musical instrument.

In accomplishing these and other objects, there is provided guitars having quick attach, quick release string securing apparatus for use with cooperating string sets of measured lengths. A first embodiment of strings has loops formed on both ends, while a second embodiment of strings has a loop formed on one end and an anchor ball secured on the other. Guitars utilizing the first embodiment of strings have crosspiece structure secured thereon carrying upwardly projecting posts around which the loops on one end of the strings can be hooked. Tuning mechanism associated with each string is included on the guitars which is made up of a tuning key driving an upwardly extending rotatable shaft. Each shaft carries a transversely extending string holding post over which the string loops on the other string ends may be hooked. While the strings hooked to extend between the crosspiece and tuning mechanisms, the tuning keys can be turned to tighten and appropriately tension the strings. The strings are made of measured lengths to be sized so that the string replacement and tightening process can be accomplished with relatively few turns of the tuning keys. The string holding ends of the string holding posts are preferably formed as ball-shaped members and may be formed by screwing balls on threaded shafts.

The guitar utilizing the second embodiment of strings has tuning mechanism like the first guitar but another embodiment of crosspiece which defines rearwardly opening slotted sockets for receiving the anchor balls secured on the ends of such strings. The slots associated with each of the sockets open upwardly and rearwardly so that the instrument strings extend upwardly and forwardly therethrough from the anchor balls positioned in the sockets.

Additional objects of the present invention reside in the specific construction of the strings, crosspieces and string securing apparatus of the musical instruments hereinafter described in conjunction with the several drawings.

DETAILED DESCRIPTION OF THE PREFERRED EMBODIMENT

Figure 1:
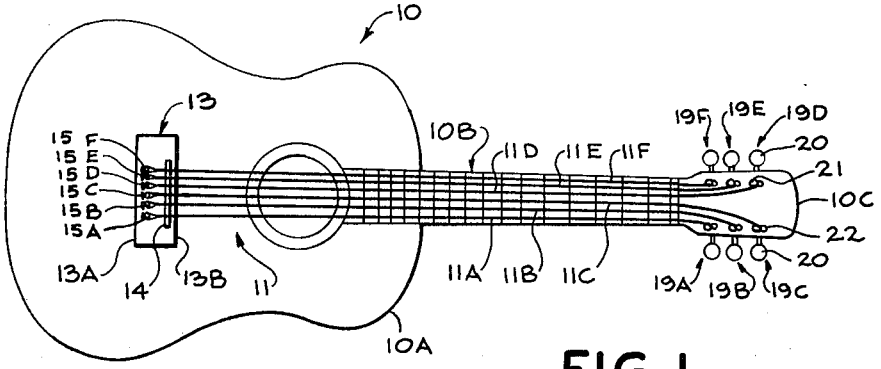
FIG. 1 is a top plan view of a guitar having a string set and string securing apparatus according to the present invention.

Referring to the drawings in more detail, there is shown in FIG. 1 a conventionally shaped guitar 10 having a base or rear portion 10A and neck portion 10B. The neck portion 10B defines at its end a handle or top portion 10C. The guitar 10 has a set of strings 11 of the type shown in FIG. 5.

Figure 5:
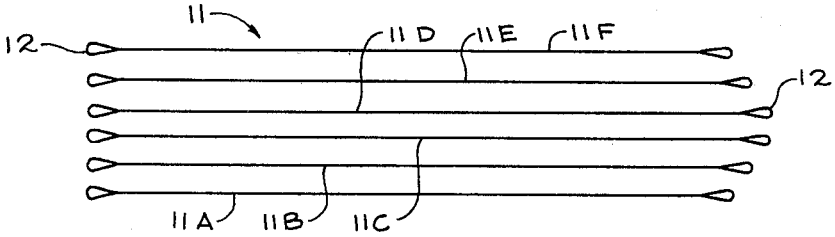
FIG. 5 illustrates a string set for the guitar of FIG. 1.

The set of instrument strings 11 is made up of six strings identified by the numerals 11A, 11B, 11C, 11D, 11E and 11F. As shown in FIGS. 1 and 5, each of the strings 11 has a similar loop 12 formed on each end. The loops 12 may be formed on the strings 11 in any suitable manner. As hereinafter discussed, strings 11A and 11F are a first measured length; strings 11B and 11E are a second measured length longer than the first measured length; and strings 11C and 11D are a third measured length longer than the second measured length.

Figure 4:
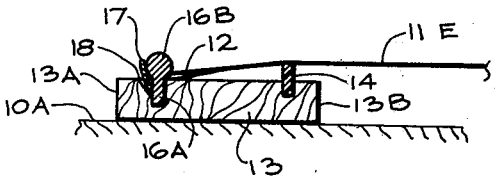
FIG. 4 is a side elevation view of one of the string holding mechanisms associated with the crosspiece of FIG. 3.

The guitar 10 has a tailpiece or crosspiece 13 secured on the face of its base portion 10A in a conventional manner, such as by being adhesively secured thereto. As shown in FIGS. 1 and 4, the crosspiece 13 is a rectangular block positioned across and normal to the longitudinal axis of the guitar 11. The crosspiece 13 has a rearwardly positioned edge 13A and a forwardly positioned edge 13B.

Mounted in the crosspiece 13 adjacent its forward edge 13B and normal to the longitudinal axis of the guitar 10 is a string bridge 14. The bridge 14 may be adhesively secured in place and is preferably made of a hard material, such as bone, and has string slots therein to hold the strings 11 appropriately spaced apart laterally.

Secured on the crosspiece 13 adjacent its rear edge 13A are six upwardly extending string holding mechanisms 15A–15F. The holding mechanisms 15 are arranged in a line normal to the longitudinal axis of the guitar 10 and are spaced apart to provide appropriate lateral spacing for the strings 11. All the string holding mechanisms 15 are similarly constructed, and FIGS. 3 and 4 illustrate the string holding mechanism associated with string 11E.

Figure 3:
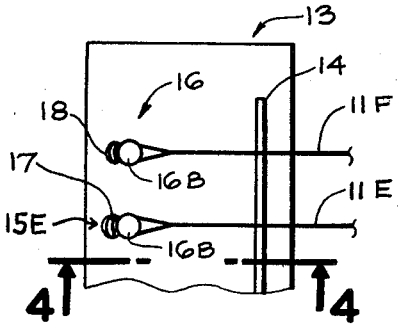
FIG. 3 is a plan view of a portion of the crosspiece and bridge structure of the guitar of FIG. 1, illustrating the string holding mechanism associated therewith.

Referring to FIGS. 3 and 4, the mechanism 15E is formed by a post structure 16 having a resilient finger 17 associated therewith. The lower end of the post 16 is a cylindrical shaft 16A while its upper end is formed as a ball-shaped member 16B, the diameter of the ball 16B being smaller than the size of a string loop 12 but larger than the diameter of the shaft 16A. The shaft 16A is secured the crosspiece 13 in a hole 18 formed therein with the ball 16B projecting above the upper surface of the crosspiece 13. The resilient finger 17 is a length of springy material secured to or against the shaft 16A to extend upwardly with its outer end biased to rest against the rearward surface of the ball 16B. The hole 18 is shaped to provide room for the resilient finger 17 to move rearwardly slightly from the surface of the ball 16B so that a string loop 12 may be selectively hooked around or slipped from the post 16. The string loop 12, when under tension as shown in FIG. 4, assumes a position substantially at the junction between the post 16A and ball 16B.

Tuning mechanism 19 associated with each string 11 is mounted in a conventional manner in the handle 10C formed on the guitar neck 10B. The tuning mechanism 19 associated with the different strings 11A–11F is respectively identified by the numerals 19A–19F.

Figure 2A:
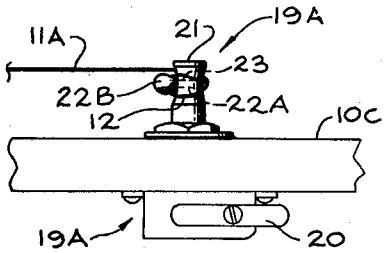
FIGS. 2A and 2B are, respectively, side elevation and top views of the string holding post associated with one of the tuning mechanisms of the guitar of FIG. 1.
Figure 2B:
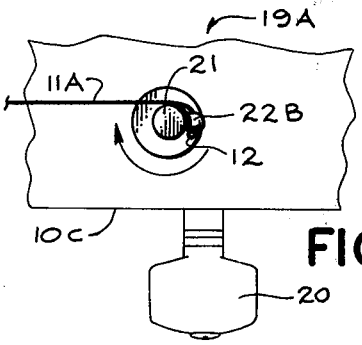

As shown in FIGS. 1 and 2, each of the tuning mechanisms 19 is formed by a tuning key 20, upwardly extending rotatably mounted shaft 21, and a string holding post 22. The tuning key 20 is connected in a conventional manner to drive or rotate the shaft 21. The shaft 21 has a conventional transverse bore 23 formed therein. The string holding post 22 has one end formed as a shaft 22A dimensioned to be force fitted in the transverse bore 23. The other end of the post 22 is formed as a ball-shaped member 22B, the diameter of the ball 22B being smaller than the size of a string loop 12 but larger than the diameter of the shaft 22A. The string loop 12 is hooked over the ball 22B of the post 22 and when under tension, as shown in FIG. 2A, assumes a position substantially at the junction between the shaft 22A and ball 22B.

To string or change a string 11 on the guitar 10, the loop 12 on one end of a string 11 is hooked over the ball 16B on the appropriate string holding post 16 while the loop 12 on the other string end is hooked over the ball 22B on the string holding post 22 associated with the appropriate tuning mechanism 19. With the string 11 so hooked to extend between the crosspiece 13 and tuning mechanism 19, the tuning key 20 of the tuning mechanism 19 is turned to rotate the shaft 21, thereby to tighten and appropriately tension the string 11.

As aforementioned, each of the strings 11 are of measured length being dimensioned just slightly longer by a selected distance, such as ¼ to ½ inch, than the distance between the string holding mechanism 15 and tuning mechanism 19 to which they correspond.

Thus, an improved string set and cooperating string securing apparatus is provided for stringed musical instruments which enables the change of instrument strings to be quickly and simply made. Such apparatus is particularly suited for use on an entertainer's guitar since it enables an entertainer to change a broken string on stage during a performance. It is noted that the resilient fingers 17 associated with the string holding posts 16 have the advantage of preventing a string from coming detached from the musical instrument while the string change is being made.

Thus, a complete change of a set of strings 11 of the guitar 10 could be made by the following procedure. First, the tuning keys 20 are turned to loosen the old strings 11 and detach their loops 12 from the posts 22. Next, the loops 12 on the other ends of the old strings 11 are slipped from the posts 16, the resilient fingers 17 yielding to permit such removal of the old strings 11 from the guitar 10. The loops 12 on the new strings 11A–11F are then slipped over the balls 16B to hook them on the posts 16 associated with the appropriate string holding mechanisms 15, the resilient fingers 17 again yielding to permit the loops 12 to be slipped on the post balls 16B. With the strings 11A–11F now attached to the guitar 10, one by one they are hooked on the post 22 associated with the appropriate tuning mechanism 19 and tightened to be brought up to proper tension.

It is noted that typically it takes on the order of seven full rotations of the tuning key 20 to rotate the rotatable shaft one-half turn and that by dimensioning the strings 11 to be of the selected measured lengths described herein, the strings can be generally tuned and brought up to proper tension in less than seven turns of the tuning key 20. This is a significant improvement over prior art arrangements which typically required fifteen or more full turns of the tuning key to properly tune and tension the instrument strings.

Figure 6:
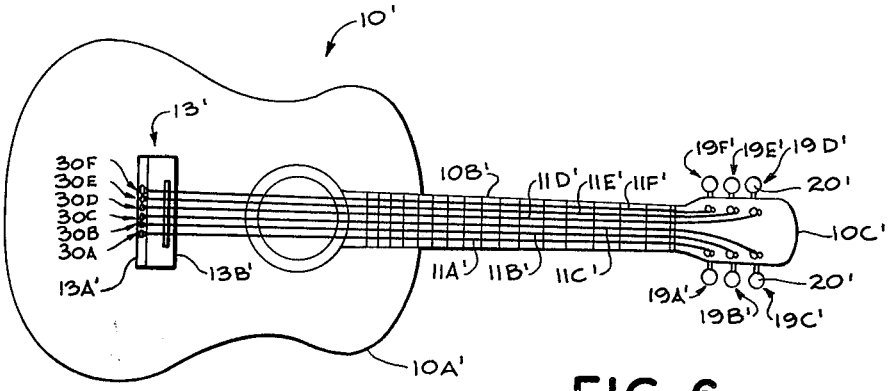
FIG. 6 is a top plan view of a guitar having another embodiment of string set and string securing apparatus according to the present invention.
Figure 7A:
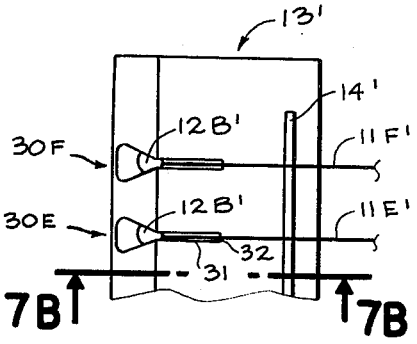
FIGS. 7A and 7B are, respectively, plane and cross-sectional elevation views of the crosspiece and bridge structure of the guitar of FIG. 6, illustrating the string holding mechanism associated therewith.
Figure 7B:
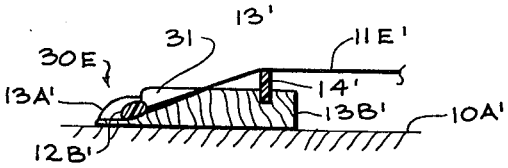
Figure 8:
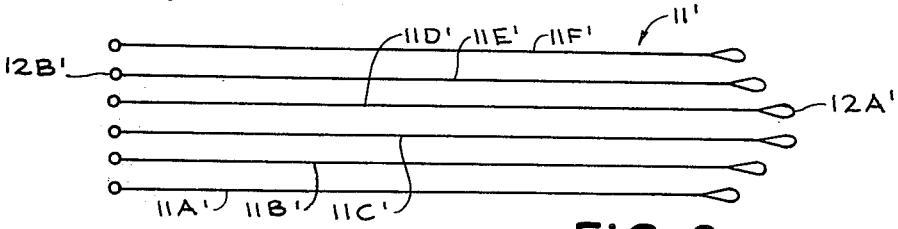
FIG. 8 illustrates a string set for the guitar of FIG. 6.

Referring to FIGS. 6–8, a guitar 10' is there shown arranged for use with an alternate embodiment of instrument string 11'. The tuning mechanism 19' associated with each of the strings 11' on the guitar 10' is identical to the above-described tuning mechanism 19 of the guitar 10 and accordingly has its corresponding parts identified by the same numeral with a prime added. Similarly, other parts of the guitar 10' corresponding to those of the guitar 10 are identified by the same numeral with a prime added.

The alternate instrument strings 11' are made up of strings 11A'–11F' which correspond in length to the earlier described strings 11A–11F, respectively. A loop 12A' is formed on one end of the strings 11A'–11F' while an anchor ball 12B' is secured on their other ends.

A crosspiece 13' is secured on the guitar 10' in the same manner as the aforementioned crosspiece 13. The crosspiece 13' defines rearwardly opening sockets 30A–30F dimensioned to receive the anchor balls 12B'. The sockets 30A–30F are appropriately spaced apart to provide appropriate lateral spacing for the strings 11A'–11F', respectively, and are slotted, having slots 31 associated therewith. The slots 31 open upwardly and rearwardly, preferably are disposed parallel to the longitudinal axis of the guitar 10', and have their lead edges 32 aligned along a line normal to the longitudinal axis of the guitar 10'. It is noted that the rear edge 13A' of the crosspiece may be rounded, inset or beveled, such as shown in FIG. 7.

FIG. 7B illustrates the anchor ball 12B' on the string 11E' pulled into the socket 30E with the string 11E' under tension extending upwardly through the slot 31 and forwardly from the slot lead edge 32.

The changing or stringing of a string 11' on the guitar 10' may be rapidly accomplished by pulling the anchor ball 12B' on the string end into the appropriate socket 30, in the manner shown in FIGS. 7, hooking the loop 12A' on the other end of the string on the string holding post 22' associated with the appropriate tuning mechanism 19' and then tightening the tuning mechanism.

Figure 9:
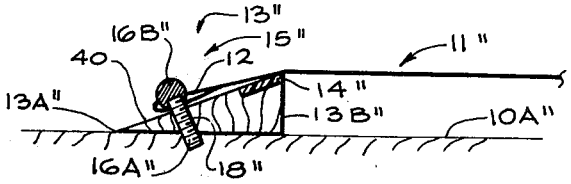
FIG. 9 is a side elevation view illustrating an alternate embodiment of crosspiece and bridge structure for use on the guitar of FIG. 1.

Referring to FIG. 9, there is shown an alternate embodiment of crosspiece 13" and bridge structure 14" for use on the guitar 10 of FIG. 1 with an instrument string set 11" of a type similar to that shown in FIG. 5.

The crosspiece 13" is illustrated secured in place by the threaded string holding post mechanism 15" on the guitar 10. The crosspiece 13" is illustrated having a triangular cross-section and defines a slanted planar surface 40 which slopes rearwardly and downwardly from its forward edge 13B" to its rear edge 13A". The bridge 14" is mounted on the crosspiece 13" by being inset in the planar surface 40 along its forward edge 13B". The bridge 14" is preferably made of a hard material like bone and has slots or grooves formed therein for holding the strings 11" appropriately spaced apart laterally.

Figure 10:
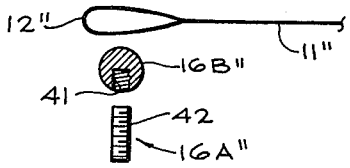
FIG. 10 is a side elevation of the string holding post associated with the crosspiece structure of FIG. 9.

A modified form of string holding post mechanisms 15" is mounted on the crosspiece 13". As shown in FIG. 10, each post mechanism 15" is made up of a ball 16B" having a threaded bore 41 formed therein which mates with threads 42 formed on the shaft 16A". The holes 18" formed in the crosspiece 13" are threaded to receive and mate with the shafts 16A" and extend at a right angle to the slanted planar surface 40. Thus, the post mechanisms 15" when threaded in the holes or bores 18" extend rearwardly at an angle to the guitar surface 10A.

The post mechanisms 15" are particularly suited for use with strings 11" which have resilient loops 12" formed thereon of wire or wire-like material which are shaped to be oblong with a transverse or narrowest dimension less than the diameter of the ball 16B", the circumference of the oblong loop being greater than the circumference of the ball 16B". Thereby, a loop 12" may be placed on a post 15" by being snapped over the ball 16B", the oblong shape of the loop 12" yielding to permit the loop 12" to pass over the ball 16B" and then returning to its oblong shape once around the shaft 16A" to hold the string 11" attached to the post 15".

The strings 11" are shown hooked on the post mechanism 15" in FIG. 9, extending therefrom across the bridge 14". The downward force of the strings 11" on the bridge 14" cooperates with the angled mounting of the posts 15" which extend into the guitar portion 10A" to balance the forces on the crosspiece 13".

Figure 11:
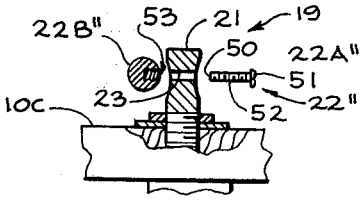
FIG. 11 illustrates an alternate embodiment of string holding post associated with one of the guitar tuning mechanisms.

FIG. 11 illustrates an alternate embodiment of string holding post 22" for use with one of the guitar tuning mechanisms 19. The post 22" is formed by shaft 22A" and ball 22B". The shaft 22A" is constructed to have its end 50 inserted through the transverse bore 23 by having a stop 51 formed on its other end, the diameter of the stop 51 being larger than the bore 23 to prevent the end of the shaft 22A" on which the stop 51 is mounted from passing therethrough. The shaft 22A" has threads 52 formed thereon which mate with a threaded bore 53 formed in the ball 22B". Thereby, the ball 22B" may be screwed on the end 50 of the shaft 22A".

Thus, a readily and selectively removable string holding post mechanism 22" is provided. It is noted that the length of the shaft 22A" should be appropriately dimensioned so that its end 50 extending from the bore 23 is not longer than the depth of the bore 53. Thereby, the ball 22B" when threaded on the shaft 22A" will fit flush against the rotatable tuning shaft 21.

Figure 12:
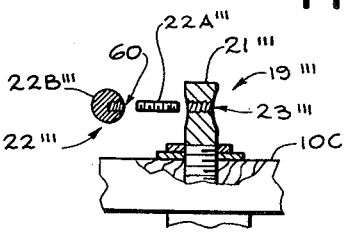
FIG. 12 is a modified form of the string holding post of FIG. 11.

FIG. 12 illustrates another embodiment of string holding post 22''' for use with a tuning mechanism 19''' having a threaded transverse bore 23'''. The shaft 22A''' of the post mechanism 22''' is threaded to mate with the bore 23''' and the ball 22B''' has a threaded bore 60 formed therein which may be threaded on the shaft 22A'''.

Although I have herein shown and described my invention in what I have conceived to be the most practical and preferred embodiments, it is recognized that departures may be made from these embodiments within the scope of the appended claims.

I claim:

1. Apparatus for stringing a stringed instrument, said instrument having forward and rear ends and said apparatus comprising:

a set of instrument strings of selected measured lengths, each of said instrument strings having first and second ends and a loop formed on both said first string end and said second string end;

means for detachably securing said second string ends on the rear end of said instrument in a laterally spaced apart disposition, said means for detachably securing said second string ends on the rear end of said instrument comprising crosspiece structure carrying upwardly extending spaced apart string holding posts over which the loops on said second string ends may be hooked;

resilient finger means associated with each of said string holding posts carried by said crosspiece for retaining the loops on said second string ends hooked around said posts; and tuning mechanism for each string arranged for mounting on the forward end of said instrument, each of said tuning mechanisms including a rotatable shaft driven by a tuning key and being arranged for mounting on the first end of said instrument with said rotatable shafts extending upwardly therefrom, each of said rotable shafts carrying string holding posts thereon over which the loops on said first string ends may be hooked so that said strings may be tightened to an appropriate tension by turning said tuning keys.

2. The invention defined in claim 1, wherein the portions of said string holding posts over which the loops on said first string ends are hooked are ball-shaped.

3. The invention defined in claim 1, wherein:

each of said rotatable shafts have a transverse bore formed therein;

each of said string holding posts has one end formed by a shaft dimensioned for fitting in said transverse bores and its other end formed as a ball-shaped member, the diameter of said ball-shaped members being larger than the diameter of said post shafts; and said string holding posts are mounted on said rotatable shafts by securing said post shafts in said transverse bores.

4. The invention defined in claim 3, wherein said post shafts are secured in said transverse bores by being force fitted therein.

5. The invention defined in claim 3, wherein:

said post shafts have stops on one end larger than the diameter of said transverse bores and are threaded on their other ends; and said ball-shaped members have threaded bores defined therein which mate with the threads on said post shafts.

6. The invention defined in claim 3, wherein:

said transverse bores are threaded; and said post shafts are threaded to mate with said transverse bores.

7. The invention defined in claim 6, wherein said ball-shaped members have threaded bores defined therein which mate with the threads of said post shafts.

8. The invention defined in claim 1, wherein the portions of said string holding posts carried by said crosspiece over which the loops on said second string ends are hooked are ball-shaped.

9. The invention defined in claim 1, wherein:

the portions of said string holding posts carried by said crosspiece over which the loops on said second string ends are hooked are ball-shaped; and the loops on said second string ends are formed of a resilient wire-like material in an oblong shape, the narrow dimension of said oblong loops being less than the diameter of said ball-shaped post portions and the circumference of said oblong loops being greater than the circumference of said ball-shaped post portions so that said oblong loops may be snap fitted thereon.

10. The invention defined in claim 9, wherein said crosspiece defines a planar surface slanted with respect to the surface of a string instrument on which it is mounted, and said string holding posts are mounted to extend normal to said slanted planar surface.

11. The invention defined in claim 10, wherein said crosspiece has a forward and rear edge, said planar surface slanting downwardly from said forward to said rear edge, and including a string bridge inset in said crosspiece along the forward edge of its planar surface, said string holding posts being mounted rearwardly of said string bridge so that instrument strings extend forwardly therefrom upwardly over said string bridge.

12. The invention defined in claim 10, wherein said string holding posts are formed by a ball threadably mated with a threaded shaft and said threaded shafts threadably mate with said crosspiece.

* * * * *